BOBBIN THREAD CONTROL MEANS FOR A LOCK STITCH SEWING MACHINE

BACKGROUND OF THE INVENTION

1. Field of the Invention

The invention relates to thread handling devices for use in sewing machine and more particularly to mechanism for pulling thread from a bobbin spool in a lock stitch sewing machine.

2. Description of the Prior Art

It is known to provide a lock stitch sewing machine with means for pulling thread from a bobbin spool for use in the formation of stitches, and it is usual for such thread pulling means to supply a constant amount of thread for each stitch regardless of the length of stitch called for. However, the feeding of constant amounts of bobbin thread regardless of stitch length requirements is a disadvantage in that it may result in stitches which are too tight and cause puckering of material being sewn, or in stitches, which are inadequately locked and tend to pull out the material.

SUMMARY OF THE INVENTION

In accordance with the invention, a lock stitch sewing machine is provided with mechanism which includes fixed thread supporting means between a bobbin spool and needle, a thread engageable member mounted for movement along an arcuate path and cooperable with the fixed thread supporting means for pulling thread from the bobbin spool, an angular extension on the thread engageable member, a feed dog for moving material under the needle, stitch regulating means for moving the feed dog according to a selected length for stitches to be formed in the material, and a member affixed to the feed dog and engageable with said angular extension for causing thread to be pulled from the bobbin spool in amounts defined in accordance with the setting of the stitch regulating means.

DESCRIPTION OF THE PREFERRED EMBODIMENT

Figure 1:
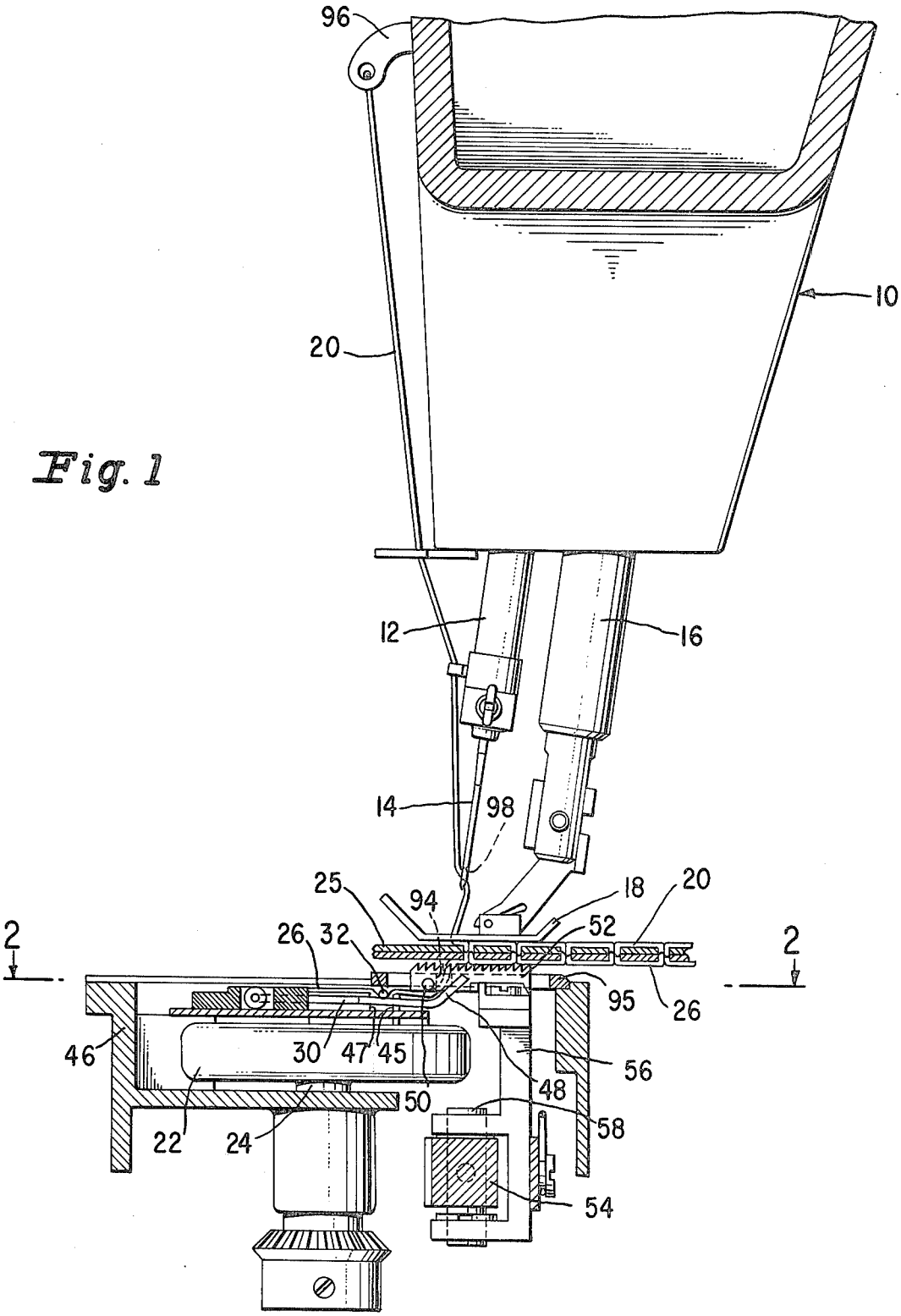
FIG. 1 is a fragmentary end elevational view partially in section of a sewing machine including bobbin thread control means according to the invention.
Figure 2:
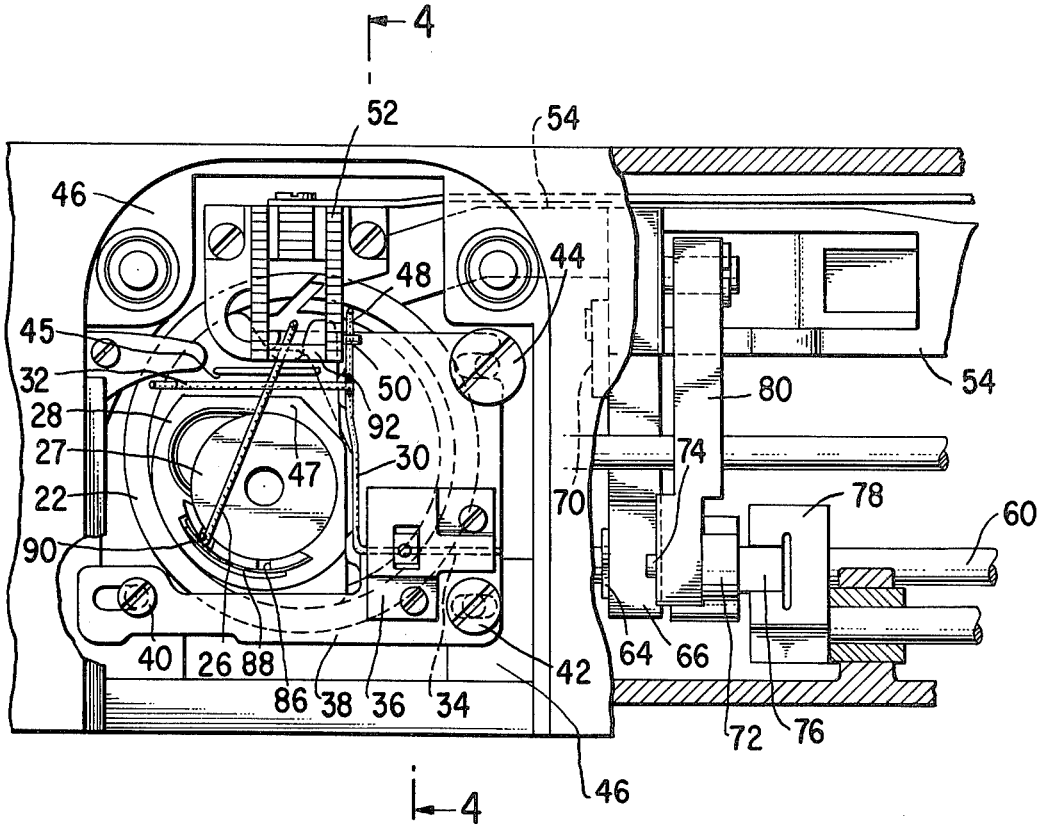
FIG. 2 is a top plan view taken on the plane of line 2—2 of FIG. 1 with portions broken away to better show the control means of the invention.

Referring now to the drawings, reference character 10 designates the head end of a lock stitch sewing machine wherein a needle bar 12 is vertically reciprocable. A sewing needle 14 is affixed in the needle bar 12 for reciprocation thereby. As shown, the head end 10 of the sewing machine carries a presser bar 16, and the presser bar carries a foot 18 which is used to hold down work as it is sewn with the needle 14.

Thread 20 is supplied to the needle 14 for use in forming stitches, and a loop taker 22 which is rotatable by a shaft 24 cooperates in a known manner with the needle 14 to cause lock stitches to be formed in material 25 with the needle thread 20 and thread 26 supplied from a bobbin spool 27 rotatably mounted in a stationary bobbin case 28. A detailed description of the manner in which such a loop taker cooperates with a needle to form lock stitches may be found, for example, in U.S. Pat. No. 2,862,468 of R. E. Johnson for "Ornamental Stitch Sewing Machines" issued Dec. 2, 1958 and assigned to The Singer Company.

In accordance with the invention, a thead pulling bar 30 including a bobbin thread engageable leg 32 is provided to pull thread from the bobbin spool 27. Such thread pulling bar is mounted to pivot on an arm 34 which is an integral part of the bar and is rotatable in a fitting 36 located on a bed plate 38 that is secured by screws 40, 42 and 44 to machine frame 46. As shown, leg 32 of the thread pulling bar extends between spaced walls 45 and 47 provided on the bobbin case 28. Thread pulling bar 30 includes as an integral part thereof, an upwardly projecting angular extension 48 which is engageable by a pin 50 on a feed dog 52 that serves in the usual manner to move material being sewn in either a forward or reverse feeding direction when the needle is out of the work such that successive stitches may be formed.

Figure 3:
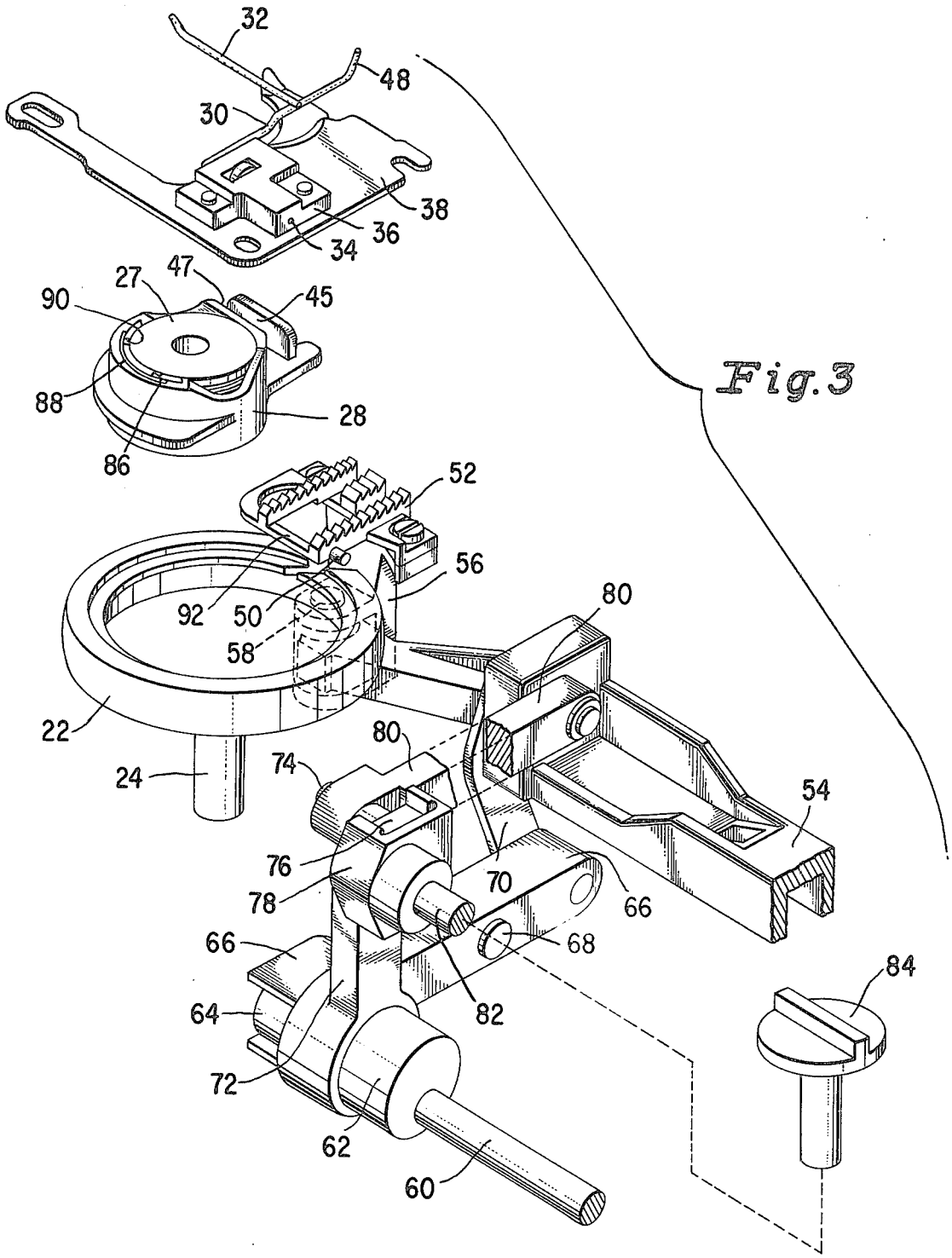
FIG. 3 is an exploded perspective view illustrating said bobbin thread control means.
Figure 4:
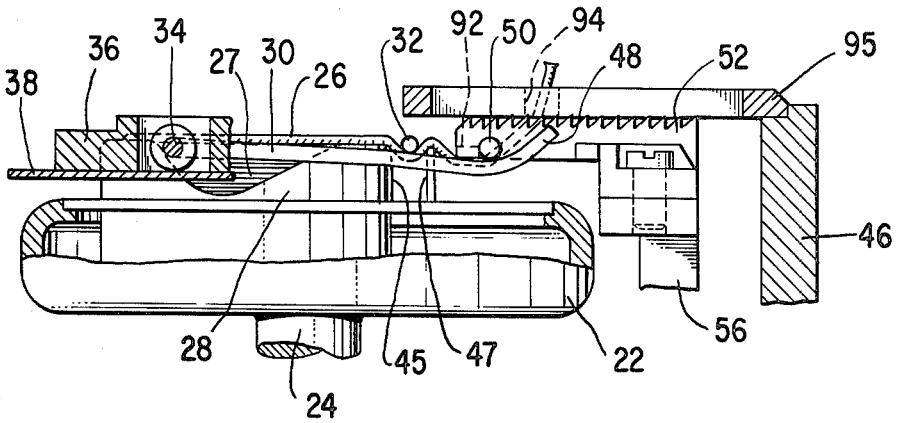
FIGS. 4 and 5 are fragmentary end elevational views showing the operation of mechanism according to the invention during the formation of short and long stitches respectively.
Figure 5:
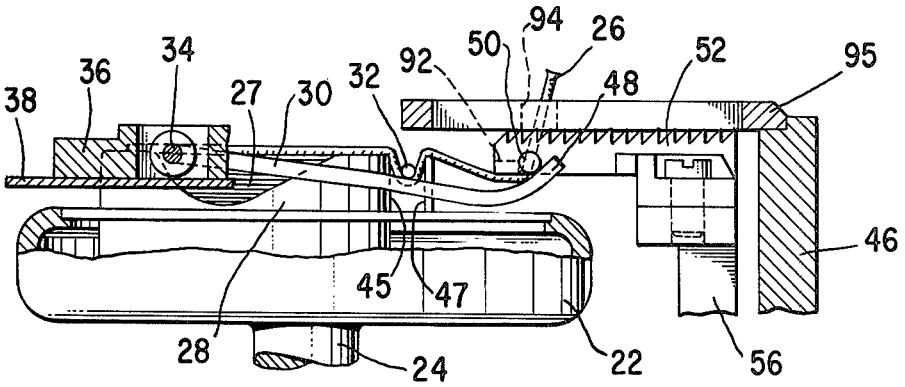

The feed dog is moved, as usual, along a more or less elliptical path as determined by a work feed control system of the type shown and described, for example, in U.S. Pat. No. 3,527,183 for "Work Feeding Mechanism for Sewing Machines" of The Singer Company, issued Sept. 8, 1972. Such work feed control system includes a feed bar 54 mounted in the machine so that it may be oscillated in mutually perpendicular directions to impart substantially vertical and horizontal motion to the feed dog 52. The feed dog is carried by a bracket 56 which is secured to a pivot pin 58 journalled in the feed bar. A bed shaft 60, journalled in the machine frame and driven in synchronism with the needle actuating mechanism of the machine rotates an eccentric 62 and a lift cam 64. The lift cam imparts vertical motion to the feed bar through a bifurcated lever 66 pivoted on a fixed stud shaft 68, and through a link 70. Transverse feed motion is imparted to the feed bar by means of the eccentric 62, pitman 72, pivot pin 74, slide block 76, feed regulator block 78 and link 80. A vertical position of the feed regulator block 78 results in zero feed, whereas a clockwise position relative thereto as viewed in FIG. 3 results in the forward feeding of material and a stitch length which is in proportion to the clockwise displacement of the block 78 from the vertical. A counterclockwise position of the regulator block relative to the vertical results in the reverse feeding of material and a stitch length which is in proportion to the counterclockwise displacement of block 78 from the vertical. Regulator block 78 is positionable by shaft 82 which is in turn is positionable by manually operable stitch length selector 84.

In preparation for sewing, the bobbin case is threaded by drawing the thread 26 from the bobbin spool 27 through a slit 86 in the case 28, under a tension spring 88 and thence through a notch 90 in the case. Beyond the notch 90, bobbin thread 26 is passed over bobbin case wall 45, under leg 32 of the tread pulling bar, and over bobbin case wall 47, after which the thread is passed under cross piece 92 of the feed dog and up through an opening 94 in throat plate 95. Thread 22 after passing through a conventional thread tensioning device (not

United States Patent [19]

Block et al.

[11] 4,182,251

[45] Jan. 8, 1980

[54] HIGH SPEED INDEXING SYSTEM

[76] Inventors: Charles Block, 1129 Albert Rd., North Bellmore, N.Y. 11710; Leon Mintz, 7 Valley Rd., Syosset, N.Y. 11781

[21] Appl. No.: 772,061

[22] Filed: Feb. 25, 1977

[51] Int. Cl.[2] ..... D05B 27/14

[52] U.S. Cl. ..... 112/322; 192/12 B; 112/320

[58] Field of Search ..... 112/214; 192/12 B; 188/264, 196 M

[56] References Cited

U.S. PATENT DOCUMENTS

| | | | |
|---|---|---|---|
| 2,860,738 | 11/1958 | Johansen | 188/196 M |
| 3,083,658 | 4/1963 | Winberg | 112/214 |
| 3,104,639 | 9/1963 | Reeber | 112/214 |
| 3,106,265 | 10/1963 | Driesch | 188/196 M |
| 3,140,760 | 7/1964 | Rasmussen | 188/264 R |
| 3,510,083 | 5/1970 | Cook | 192/12 B |
| 3,747,827 | 7/1973 | Stanton et al. | 112/214 |

*Primary Examiner*—Samuel Scott
*Assistant Examiner*—Wesley S. Ratliff, Jr.
*Attorney, Agent, or Firm*—Paul J. Sutton

[57] ABSTRACT

The present invention teaches a high-speed indexing system for use with any number of fabric-moving apparatus, a novel braking system for use within the indexing system, and a novel puller accessory. The high-speed adjustable indexing system is illustrated in connection with a sewing machine, as an example. In sewing machine applications, a synchronized intermittent advancement of fabric in unison with the movement of an associated feed dog is provided. Undesirable inertia-caused roller overshooting, heretofore treated with anti-reverse clutches and other approaches, is eliminated, thereby enabling high speed indexing at machine operating speeds conventionally unattainable in the art. An adjustable spring-biased braking arrangement is provided which may be preset for known machine operating speeds.

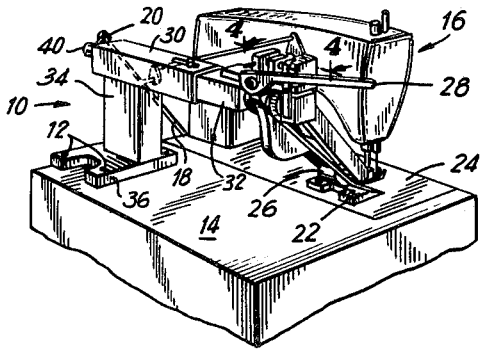

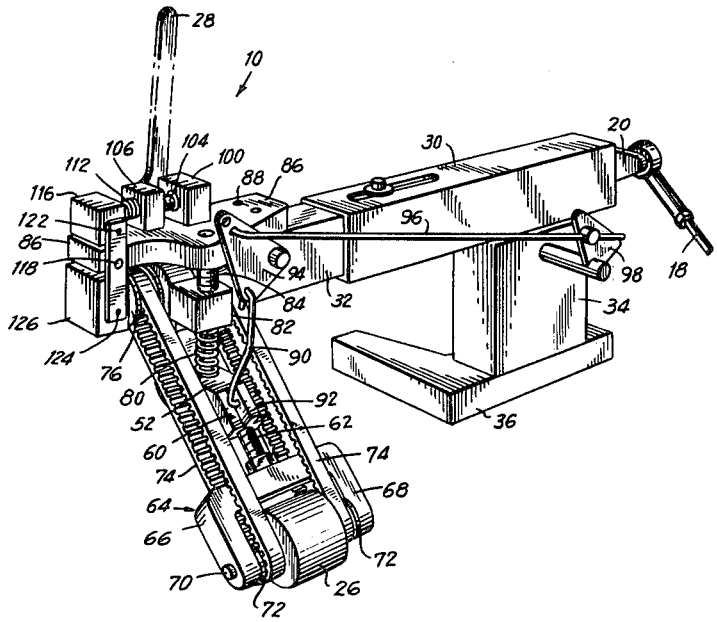

5 Claims, 11 Drawing Figures